US011759964B2

(12) United States Patent
Ntavos et al.

(10) Patent No.: US 11,759,964 B2
(45) Date of Patent: Sep. 19, 2023

(54) RAZOR CONNECTORS

(71) Applicant: BIC VIOLEX S.A., Anoixi (GR)

(72) Inventors: Vasileios Ntavos, Athens (GR); Georgios Koulourias, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 156 days.

(21) Appl. No.: 17/251,075

(22) PCT Filed: Jul. 12, 2019

(86) PCT No.: PCT/EP2019/068791
§ 371 (c)(1),
(2) Date: Dec. 10, 2020

(87) PCT Pub. No.: WO2020/011963
PCT Pub. Date: Jan. 16, 2020

(65) Prior Publication Data

US 2021/0122072 A1 Apr. 29, 2021

(30) Foreign Application Priority Data

Jul. 12, 2018 (EP) ..... 18183236

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
USPC ..... 30/47–51, 526, 527, 531
See application file for complete search history.

(56) References Cited

U.S. PATENT DOCUMENTS 3,935,639 A * 2/1976 Terry ..... B26B 21/225 30/47
4,128,937 A 12/1978 Adorney
(Continued)

FOREIGN PATENT DOCUMENTS

CN 101080308 A 11/2007
CN 201645522 U 11/2010
(Continued)

OTHER PUBLICATIONS

International Search Report and Written Opinion in International Application No. PCT/EP2019/068791, dated Oct. 18, 2019 (13 pages).
(Continued)

*Primary Examiner* — Jason Daniel Prone
(74) *Attorney, Agent, or Firm* — Bookoff McAndrews, PLLC

(57) ABSTRACT

A razor connector for including a main body configured to be attached to the razor handle, the main body having a substantially flat portion and peripheral ends bent towards the flat portion, and an upper portion configured to be attached to a razor cartridge, the upper portion being adjacent to the substantially flat portion of the main body, and the razor connector beeing a monolithic resilient element configured to connect the razor cartridge with the razor handle and to resiliently suspend the razor cartridge when attached to the razor handle.

18 Claims, 2 Drawing Sheets

(56) References Cited

U.S. PATENT DOCUMENTS 4,152,828 A * 5/1979 Lund ..... B26B 21/225 30/529
4,475,286 A * 10/1984 Saito ..... B26B 21/225 30/50
4,780,959 A 11/1988 Sinka
4,791,724 A * 12/1988 Dumas ..... B26B 21/18 30/48
5,038,472 A * 8/1991 Iderosa ..... B26B 21/225 30/51
5,050,301 A * 9/1991 Apprille, Jr. ..... B26B 21/521 30/43.3
5,560,106 A * 10/1996 Armbruster ..... B26B 21/225 30/526
5,600,887 A * 2/1997 Olson ..... B26B 21/521 30/527
5,953,825 A * 9/1999 Christman ..... B26B 21/225 30/527
6,122,826 A * 9/2000 Coffin ..... B26B 21/225 30/527
6,223,442 B1 5/2001 Pina
6,311,400 B1 11/2001 Hawes et al.
6,615,498 B1 * 9/2003 King ..... B26B 21/521 30/527
7,574,809 B2 * 8/2009 Folio ..... B26B 21/225 30/527
7,770,294 B2 * 8/2010 Bruno ..... B26B 21/225 30/526
8,033,023 B2 10/2011 Johnson et al.
8,671,577 B2 * 3/2014 Brown ..... B26B 21/521 30/526
8,898,909 B2 * 12/2014 Schmitt ..... B26B 19/048 30/527
9,522,472 B2 12/2016 Leicht et al.
10,843,357 B2 * 11/2020 Jang ..... B26B 21/225
11,298,843 B2 * 4/2022 Kopelas ..... B26B 21/521
2002/0104223 A1 * 8/2002 Oldroyd ..... B26B 21/225 30/527
2003/0079348 A1 5/2003 Folio
2004/0177519 A1 * 9/2004 Tomassetti ..... B26B 21/225 30/527
2006/0260131 A1 11/2006 Folio
2012/0210586 A1 * 8/2012 Lelieveld ..... B26B 21/225 30/527
2014/0068953 A1 * 3/2014 Wonderley ..... B26B 21/521 30/527
2016/0151925 A1 * 6/2016 Gers-Barlag ..... B26B 21/225 30/526
2017/0165853 A1 * 6/2017 Li ..... B26B 21/521
2020/0114535 A1 * 4/2020 Wattam ..... B26B 21/225
2020/0353633 A1 * 11/2020 Athanassiou ..... B26B 21/4018
2021/0187768 A1 * 6/2021 Lee ..... B26B 21/225

FOREIGN PATENT DOCUMENTS

EP 0429174 A2 5/1991
EP 1671761 A1 6/2006
WO 9823417 A1 6/1998

OTHER PUBLICATIONS

First Search Report in corresponding Chinese Application No. CN201980039687 dated Mar. 22, 2022 (2 pages).

* cited by examiner

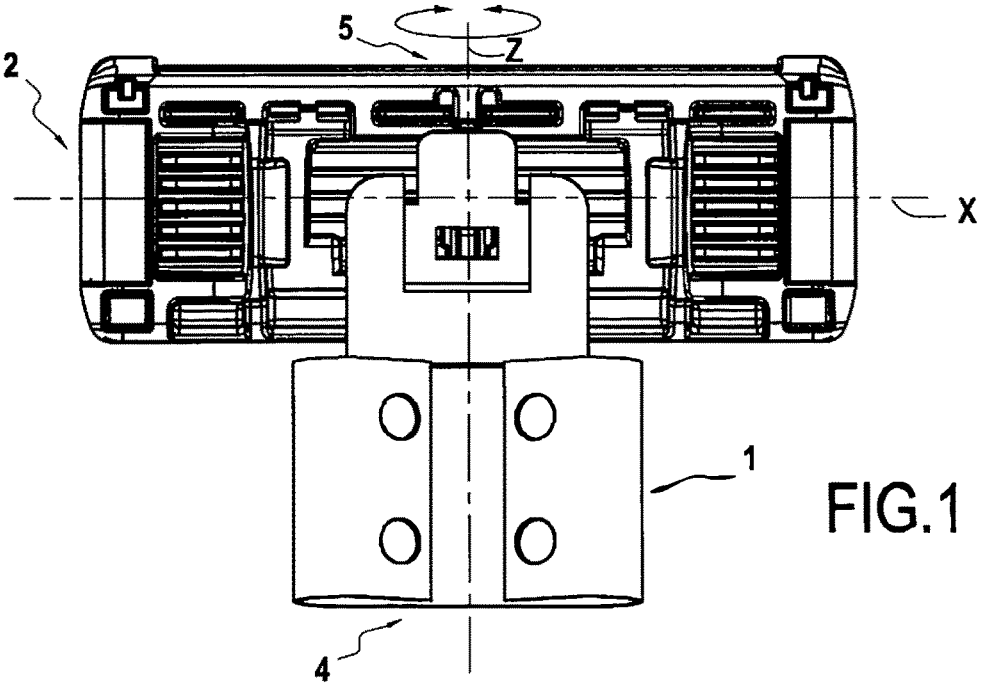
FIG.1
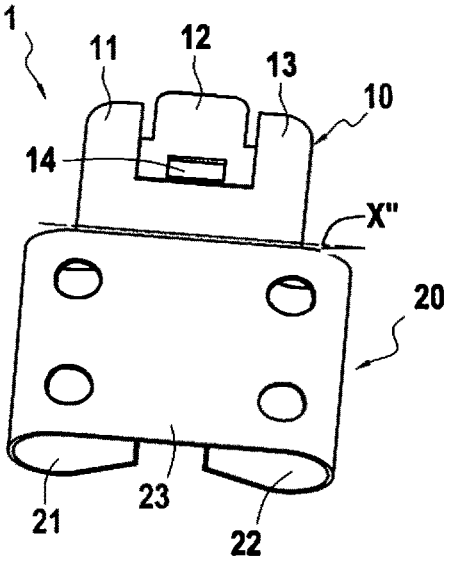
FIG.2A
FIG.2B
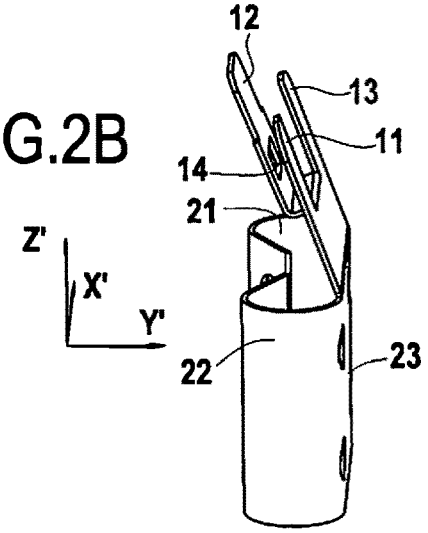
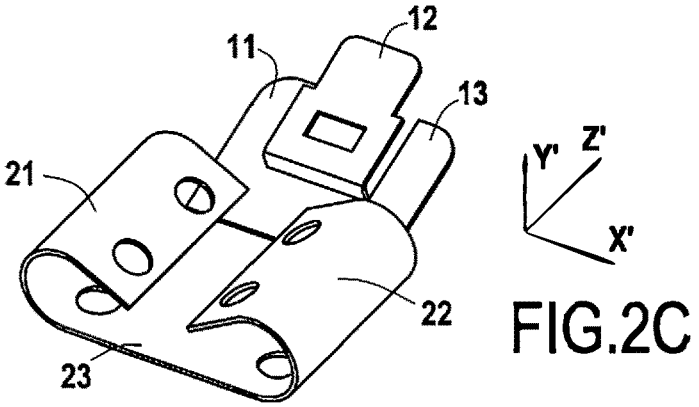
FIG.2C

RAZOR CONNECTORS

This application is a National Stage Application of International Application No. PCT/EP2019/068791, filed on Jul. 12, 2019, now published as WO/2020/011963 which claims benefit from European patent application EP 18183236.1 filed on Jul. 12, 2018, entitled "RAZOR CONNECTORS".

The present disclosure concerns to razor connectors for connecting a razor cartridge to a razor handle. The present disclosure in particular relates to non-motorized razors comprising a razor cartridge and a razor handle connected to each other by such razor connectors.

BACKGROUND ART

Known non-motorized razors comprise a rigid handle and a razor cartridge connected to it. In case the razor is non-disposable, i.e. configured to be re-usable, the razor cartridge can be detached from the handle such that it can be replaced by a new razor cartridge.

It is further known to resiliently connect the razor cartridge to the razor handle, such that the razor cartridge is pivotable with respect to the handle. In this way shaving can be facilitated. For example, U.S. Pat. No. 6,223,442B1 discloses a non-motorized razor having a rigid handle, a thin resilient leaf spring of flat cross section supported at a first end on the handle having a free end portion extending outwardly therefrom, and a generally rectangular blade-carrying razor head attached transversely at its approximate center on the free end portion of the spring in a plane approximately tangent to the plane of the spring with its lateral ends extending laterally outwardly. The spring free end portion is resiliently flexible in vertical and horizontal planes and capable of twisting along its central longitudinal axis.

Further razors with resiliently suspended or pivotable razor cartridges, in particular replaceable razor cartridges, are known from e.g. U.S. Pat. No. 6,311,400B1, EP1671761B1 and US20030079348A1.

However, known razors comprise a rather complex attachment structure for attaching the razor cartridge to the handle. This increases manufacturing costs and deteriorates the reliability of the attachment structures.

It thus remains desirable to provide improved razor connectors for connecting a razor cartridge to a razor handle.

SUMMARY

In a first aspect, a razor connector for connecting a razor cartridge to a razor handle is provided. The connector comprises a resilient element configured to connect a razor cartridge with a razor handle and to resiliently suspend the cartridge when attached to the handle. The resilient element has a main body configured to be attached to the razor handle. Further, the main body has a substantially flat portion and peripheral ends bent towards the flat portion.

According to this aspect, the provision of the peripheral bent ends towards the flat portion provides a more versatile razor connector. For example, in a razor, when the cartridge and the handle are mounted to herein disclosed connector, the peripheral bent ends allow a resilient movement of the cartridge with respect to the handle. This occurs due to the resiliency of the bent ends.

Another aspect provides for a razor comprising a razor cartridge comprising one or more blades and a razor handle connected to each other through the razor connector substantially as hereinbefore described.

For example, the resilient element may be formed such that it achieves two functions: a removable attachment of the razor cartridge to the razor handle, and a resilient suspension of the razor cartridge in its attached state, i.e. when the razor cartridge is attached to the razor handle by the razor connector. In other words, a simple bent leaf may be used to achieve two different functions in the razor. In this way manufacturing costs can be reduced, as a simplified structure of the razor connector is used. At the same, due to this simple structure comprised of a sole component (i.e. the respectively formed leaf), the reliability of the razor connector is enhanced. For example, since the razor connector does not comprise several components that need to be connected to each other e.g. by any joints or any other means, the risk that the razor connector breaks into such different components is avoided or at least reduced.

The peripheral ends may be U-shaped.

For example, the formed leaf may have a bent cross section (in particular in a view directed from the proximal end to the distal end of the razor connector) such that the formed leaf defines a volume.

In this way, in particular due to the bent ends, the resilient element may form a relatively bulky or voluminous object compared to the (originally flat) leaf of which the resilient element is formed. Hence, the resilient element may be easily manufactured from an originally flat resilient leaf (or sheet) and may have different forms. In examples, the resilient element may be formed such that it allows a secure attachment of the razor cartridge to the handle.

The razor connector may consist of a leaf spring element.

The razor connector may further comprise an upper portion configured to be attached to the razor cartridge, the upper portion being adjacent to the flat portion of the main body.

The upper portion and the main body may be integrally formed.

For example, at least a section of the razor connector between the proximal and the distal end (and/or between the main body and the upper portion) may be formed by the resilient leaf spring element. Accordingly, the razor connector may be pivotable about at least a first axis which is parallel to the extension of the razor cartridge and may be in a section of the razor connector between the proximal and the distal end.

When the main body is attached to the razor handle, the upper portion of the razor connector may extend outwardly from the razor handle.

In an example, the main body may be configured to be non-removably attached to the razor handle.

In a further example, the main body may be configured to be located within a proximal end of the razor handle such that the upper portion of the leaf spring connector extends outwardly of the proximal end of the razor handle.

Accordingly, the razor connector can be reliably secured to the razor handle.

In still a further example, the main body may comprise a bent cross section such that the main body encloses a volume and fits into an opening within the proximal end of the razor handle.

Accordingly, due to the bent form of the main body (in particular in a view directed from the proximal end to the distal end of the razor connector) the main body can fill the space within the opening of the razor handle to provide a reliable fitting or attachment of the razor connector to the handle.

The upper portion may be formed as a clip, for example configured to removably attach the razor connector to the razor cartridge.

In this manner, or as an alternative thereto, the upper portion may be formed as a fork having a plurality of tines, for example configured to be removably attached to the razor cartridge.

Accordingly, the tines may be configured to be inserted into the razor cartridge, e.g. into openings of the razor cartridge, in order to provide a reliable attachment. At the same time the upper portion may be formed of the single resilient leaf which may be formed, e.g. cut, to constitute the fork form.

The plurality of tines may be formed such that at least one tine is offset with regards to the others (these other tines) defining a two-dimensional area. In other words, a the at least one tine is offset to the two dimensional area defined by the other tines.

For example, the plurality of tines may be formed such at least one tine is offset with regard to the others. In this way in a cross sectional view directed from the proximal end to the distal end of the razor connector the tines may define a two dimensional area.

In other words, the tines (i.e. at least three tines) may be offset to each other in such a way that they are arranged in at least two different planes, or in still other words, such that the tines border a three-dimension space. In this way a three-dimensional connection of the razor connector to the razor cartridge may be achieved which ameliorates the fixation of the razor connector to the cartridge. This is in particular useful when the razor cartridge is pivoted around several orthogonal axis.

At least one tine includes an opening configured to be coupled with a protrusion of the razor cartridge.

The razor connector may be configured to extend from a proximal end where the razor handle is attached to a distal end where the razor cartridge is attached, and in a cross sectional view directed from the proximal end to the distal end of the razor connector, the peripheral ends may be bent towards each other forming facing U-shaped ends.

In other words, when viewed from the proximal side toward the distal side of the razor connector, in a cross section of the main body the left and right ends of the resilient leaf forming the main body may be bent each to form a U-form. The two U-forms may face each other. In other words they may be arranged symmetrically.

Furthermore, such a configuration of the main body allows pivoting the razor cartridge around a second axis Z which is perpendicular to the razor handle and perpendicular to the extension of the razor cartridge and particularly perpendicular to the first axis X. The resilient ends having facing U-forms may namely be deformed when the cartridge is rotated about the axis Z. For example, during pivoting, one of the two U-forms (depending on the direction of rotation) is deformed towards the direction of rotation while the other is deformed in a direction opposite to the direction of rotation.

The resilient leaf spring element may be bent and a blank and/or cut metal leaf. Accordingly, the leaf spring element may be simply manufactured what reduces the manufacturing costs of the razor connector.

The present disclosure further relates to a razor comprising the razor connector as described above, a razor cartridge, and a razor handle. The razor handle may be connected to the razor cartridge through the razor connector.

For example, the razor handle may extend into a first direction and the razor cartridge may extend into a second, perpendicular direction.

In a further example, the handle may be releasably connected to the razor cartridge by the razor connector. In this way the handle may be re-used by exchanging the razor cartridges.

The razor cartridge may comprise an interconnecting member configured to be coupled to the razor connector such that the handle is releasably connected to the razor cartridge.

For example, the razor connector may be directly connected to the cartridge through the interconnecting member, in case the handle is non removably attached to the cartridge The razor connector may be fixedly attached to the razor cartridge.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, and serve to explain the principles thereof.

BRIEF DESCRIPTION OF THE DRAWINGS

Non-limiting examples of the present disclosure will be described in the following, with reference to the appended drawings, in which:

FIG. 1 shows a schematic representation of a front view of the razor connector attached to a razor cartridge according to embodiments of the present disclosure;

FIG. 2A shows a schematic representation of a first perspective view (from a lower back side) of the razor connector according to embodiments of the present disclosure;

FIG. 2B shows a schematic representation of a second perspective view (from a lateral side) of the razor connector of FIG. 2A;

FIG. 2C shows a schematic representation of a third perspective view (from a lower front side) of the razor connector of FIG. 2A and 2B;

DETAILED DESCRIPTION OF EXAMPLES

Figure 3A:
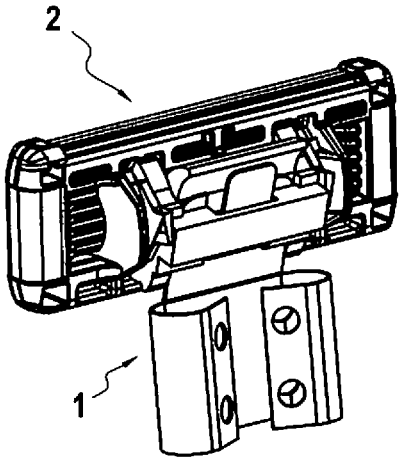
FIG. 3A shows a schematic representation of a first perspective view (from a back side) of the razor connector attached to a razor cartridge according to embodiments of the present disclosure.

Wherever possible, the same reference numbers will be used throughout the drawings to refer to the same or like parts.

As used in this disclosure and in the appended claims, the singular forms "a", "an", and "the" include plural referents unless the content clearly dictates otherwise. As used in this disclosure and in the appended claims, the term "or" is generally employed in its sense including "and/or" unless the content clearly dictates otherwise.

The detailed description and the drawings, which are not necessarily to scale, depict illustrative aspects and are not intended to limit the scope of the present disclosure. The illustrative aspects depicted are intended only as exemplary. Other alternatives, modifications, uses and/or equivalents thereof are possible. Furthermore, all possible combinations of the described examples are also covered.

FIG. 1 shows a schematic representation of a front view of a razor connector 1 attached to a razor cartridge 2 according to examples of the present disclosure.

The razor connector consists of a single resilient leaf which is formed, e.g. cut and bent. The razor connector thus comprises a resilient element made from the single resilient leaf. The resilient leaf is thus formed to a resilient element that it provides two functions at the same time: a removable attachment of the razor cartridge 2 to the handle (not shown in FIG. 1, cf. e.g. FIG. 3B), and a resilient suspension of the cartridge 2 in its attached state.

FIG. 2A shows a schematic representation of a first perspective view (from a lower back side) of the razor connector 1 according to examples of the present disclosure. FIG. 2B shows a schematic representation of a second perspective view (from a lateral side) of the razor connector 1 of FIG. 2A. FIG. 2C shows a schematic representation of a third perspective view (from a lower front side) of the razor connector 1 of FIG. 2A and 2B.

The razor connector 1 extends from a proximal end 4 (in FIG. 2A-C on a lower side) to a distal end 5 (along axis Z in FIG. 1). The razor connector 1 comprises a main body 20 at its proximal end 4, the main body 20 being configured to be attached to the razor handle, and an upper portion 10 at its distal end 5 (in FIG. 2A-C on a upper side), the upper portion 10 being configured to be removably attached to the razor cartridge 2.

As shown in particular in FIG. 2B or 2C, the formed leaf (razor connector 1) has a bent cross section in a plane x', y', or in other words, in a view directed from the proximal end 4 to the distal end 5 of the razor connector 1. In this way the resulting razor connector fills a volume x', y', z', compared to the (originally flat) leaf from which the resilient element is formed thereby forming a bulky razor connector.

At least the section of the razor connector (cf. e.g. the region where axis X" is indicated in FIG. 2A) between the main body 20 and the upper portion 10 is configured to function as a resilient spring element in the razor connector 1. Accordingly, the razor connector 1 may be pivotable about at least a first axis X" (cf. also FIG. 2A) which may be parallel to the extension of the razor cartridge and substantially parallel to the blades and may be in a section of the razor connector between the proximal and the distal end.

Figure 3B:
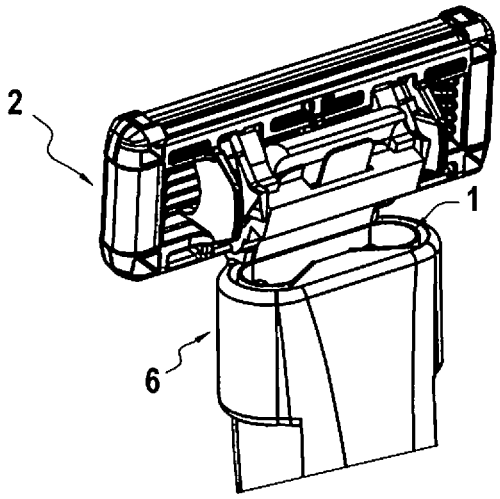
FIG. 3B shows a schematic representation of a second perspective view (from a lateral side) of the razor connector of FIG. 2A connected to a razor cartridge and to a razor handle according to embodiments of the present disclosure.
Figure 3C:
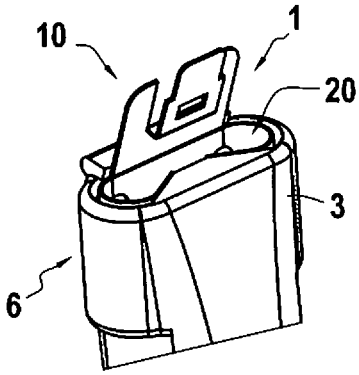
FIG. 3C shows a schematic representation of a third perspective view (from a lateral side) of the razor connector of FIG. 3A and RB connected only to a razor handle according to embodiments of the present disclosure.

Further in these examples, the main body 20 comprises a bent cross section defining a volume (cf. e.g. FIG. 2B) that in use, i.e. when the razor cartridge and the razor handle are put together by the razor connector, fits into an opening within the proximal end of the razor handle 3 (cf. e.g. FIG. 3C. Accordingly, due to the bent shape of the main body 20, the main body 20 is further comprised of a central portion 23 having a flat shape and of peripheral ends (i.e. in its lateral left and right portions in the example of FIG. 2A) bent towards each other forming facing U-shaped ends 21, 22. Hence, in a z'-direction (cf. FIG. 2B), i.e. in a cross sectional view directed from the proximal end to the distal end of the razor connector, the main body 20 comprises peripheral ends bent to form facing U-shaped ends 21, 22.

In some examples, the upper portion 10 is formed as a clip configured to removably attach the razor connector 1 to the razor cartridge 2. In more examples, the clip may be also regarded as a fork having a plurality of tines 11-13 configured to be removably attached to the razor cartridge 2.

In examples, in order to form a clip the plurality of tines 11-13 may be formed such at least one tine is offset with regard to the others (cf. in particular FIG. 2B). In this way the tines 11-13 are arranged in at least two different planes. E.g. as illustrated in the example of FIG. 2C, the central tine 12 may be in a first plane and the peripheral tines 11 and 13 in a second plane, e.g. closer to the main body 20.

In some examples as further shown in FIGS. 2A-2C, the central tine 12 includes an opening 14 configured to engage with a protrusion of the razor cartridge. Furthermore, the central tine 12 may be slightly longer that the razor cartridge such that when mated, the central tine 12 protrudes out of an insertion opening of the razor cartridge (cf. e.g. FIG. 3A). In this way the opening 14 engages with the respective protrusion of the razor cartridge 2 keeping the cartridge in its position and ready to use. Only when the central tine 12 is slightly bended in an appropriate manner in an operation state of the razor, the protrusion of the cartridge and the opening 14 of the razor connector 1 can be disengaged, such that the razor cartridge 2 can be removed from the razor connector and thus from the handle. Hence, the connector 1 allows a secure connection of the cartridge 2 to the handle 3.

In one example the cartridge may be non-removably attached to the handle. In this case, the upper portion 10 comprising the tines 11-13 and the opening 14, is fixedly attached to the razor cartridge, for example by ultrasonic welding, laser welding, gluing or by any other suitable means.

FIG. 3A shows a schematic representation of a first perspective view (from a back side) of the razor connector 1 attached to a razor cartridge 2 according to examples of the present disclosure. As shown in this figure, the razor cartridge 2 comprises one or several openings (or slots) which are configured to receive the tines 11-13 and similarly as explained in connection with FIGS. 2A-2C the razor connector and the razor cartridge may comprise an opening-protrusion assembly such that the razor connector 1 is securely connected to the cartridge 2.

FIG. 3B shows a schematic representation of a second perspective view (from a lateral side) of the razor connector 1 of FIG. 2A connected to a razor cartridge 1 and to a razor handle 3 according to examples of the present disclosure. FIG. 3C shows a schematic representation of a third perspective view (from a lateral side) of the razor connector 1 of FIG. 3A and 3B connected only to a razor handle 3 according to examples of the present disclosure.

As shown, in particular in FIG. 3C, the main body 20 is configured to be housed within a distal end of the razor handle 3 (in view of axis Z in FIG. 1) such that the upper portion 10 of the razor connector 1 extends outwardly or protrudes from the distal end 6 of the razor handle 3.

In examples, the main body 20 is formed such that it fills the space within an opening of the razor handle 3 to provide a reliable fitting or attachment of the razor connector 1 to the handle 3. In other words, the outer (3D) shape of the main body 20 may be adapted to the opening of the razor handle 3. Such a configuration of the main body allows pivoting of the razor cartridge 1 around an axis Z (cf. FIG. 1) which is substantially perpendicular to a razor handle central axis and/or, in examples, substantially perpendicular to first axis X. First axis X and second axis z may intersect each other. The U-shaped ends 21 and 22 substantially as herein disclosed may thus be deformed when the razor cartridge 1 is rotated about the second axis Z. For example, during pivoting, one of the two U-shaped ends (depending on the direction of rotation) may be deformed towards the direction of rotation while the other may be deformed in a direction opposite to the direction of rotation thereby softening movement of the razor cartridge.

In some examples, the main body 20 may be configured to be non-removably attached to the razor handle 3, e.g. it may be glued to the handle 3.

Figure 4:
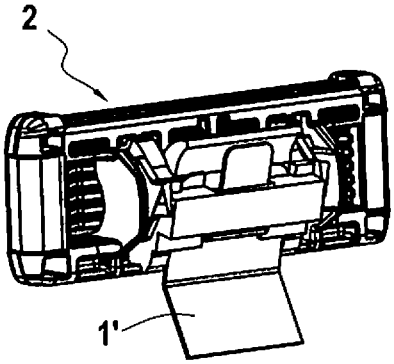
FIG. 4 shows a schematic representation of a perspective view (from a back side) of a razor connector attached to a razor cartridge.

FIG. 4 shows a schematic representation of a perspective view (from a back side) of a razor connector 1 attached to a razor cartridge 2.

In this example, the upper portion 10 of the razor connector 1' has substantially the same structure as described above. However, the main body 20 of the razor connector 1' has the shape of the central portion 23 having the flat leaf or sheet shape, i.e. without the peripheral U-shaped ends. Accordingly, the manufacturing process may be slightly simplified (cf. to the embodiments described above). With this configuration of the razor connector, the razor cartridge is only capable of pivoting about the first axis X.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular examples, it is to be understood that these examples are merely illustrative of the principles and applications of the present disclosure.

It is intended that the specification and examples be considered as exemplary only, with a true scope of the disclosure being indicated by the following claims.

The invention claimed is:

1. A razor connector, the razor connector comprising:

a main body configured to be attached to a razor handle, the main body including a substantially flat portion and peripheral ends bent towards the substantially flat portion, and an upper portion configured to be attached to a razor cartridge, the upper portion being adjacent to the substantially flat portion of the main body, wherein the razor connector is a monolithic resilient element configured to connect the razor cartridge with the razor handle and to resiliently suspend the razor cartridge when attached to the razor handle.

2. The razor connector according to claim 1, wherein the peripheral ends are U-shaped.

3. The razor connector according to claim 1, wherein when the main body is attached to the razor handle, wherein the upper portion of the razor connector extends outwardly from the razor handle.

4. The razor connector according to claim 1, wherein the upper portion is formed as a clip.

5. The razor connector according to claim 1, wherein the upper portion is formed as a fork having a plurality of tines.

6. The razor connector according to claim 5, wherein at least one tine of the plurality of tines includes an opening configured to be coupled with a protrusion of the razor cartridge.

7. The razor connector according to claim 5, wherein the plurality of tines is formed such that at least one tine is offset with regards to the other tines defining a two-dimensional area.

8. The razor connector according to claim 7, wherein at least one tine of the plurality of tines includes an opening configured to be coupled to the razor cartridge.

9. The razor connector according to claim 1, wherein the razor connector includes:

a proximal end configured to be attached to the razor handle, wherein at least a proximal portion of the main body defines the proximal end, and a distal end, configured to be attached to the razor cartridge, wherein the upper portion defines the distal end, and in a cross sectional view directed from the proximal end to the distal end of the razor connector, each of the peripheral ends forms a U-shaped end facing the other peripheral end.

10. The razor connector according to claim 1, wherein the razor connector is formed from a bent blank or cut metal leaf.

11. The razor connector according to claim 1, wherein, when the main body is attached to the razor handle, the upper portion of the razor connector extends outwardly from the razor handle.

12. The razor connector according to claim 1, wherein the razor connector is formed from a single resilient leaf.

13. A razor comprising the razor connector according to claim 12, a razor cartridge comprising one or more blades, and a razor handle connected to the razor cartridge through the razor connector.

14. A razor comprising:

a razor connector according to claim 1, a razor cartridge comprising one or more blades, and a razor handle connected to the razor cartridge through the razor connector.

15. The razor according to claim 14, wherein the razor handle is releasably connected to the razor cartridge.

16. The razor according to claim 14, wherein the razor connector is fixedly attached to the razor cartridge.

17. A razor connector, the razor connector comprising:

a main body, wherein the main body includes a flat portion and peripheral ends bent towards the flat portion, wherein the flat portion and the peripheral ends define a volume configured to be attached to a razor handle, and an upper portion configured to be attached to a razor cartridge, the upper portion being adjacent to the substantially flat portion of the main body, wherein the razor connector is a resilient element configured to connect the razor cartridge with the razor handle and to resiliently suspend the razor cartridge when attached to the razor handle.

18. A razor connector, the razor connector comprising:

a main body, wherein the main body includes a flat portion and peripheral ends bent towards the flat portion, wherein the flat portion and the peripheral ends define a volume configured to be attached to a razor handle, and an upper portion configured to be attached to a razor cartridge, the upper portion being adjacent to the substantially flat portion of the main body, wherein the razor connector is a unitary resilient element configured to connect the razor cartridge with the razor handle and to resiliently suspend the razor cartridge when attached to the razor handle, wherein the upper portion is formed as a fork having a plurality of tines, wherein the plurality of tines is formed such that at least one tine is offset with regards to the other tines defining a two-dimensional area.

* * * * *